United States Patent [19]

Broderick et al.

[11] 4,402,645

[45] Sep. 6, 1983

[54] LOAD SUPPORT ASSEMBLY

[75] Inventors: Ross T. Broderick, Dubuque, Iowa; Dennis L. Munns, Lancaster, Wis.

[73] Assignee: Deere & Company, Moline, Ill.

[21] Appl. No.: 248,156

[22] Filed: Mar. 30, 1981

[51] Int. Cl.[3] ..... B66F 9/12

[52] U.S. Cl. ..... 414/685; 414/785; 414/917; 414/664

[58] Field of Search ..... 414/607, 640, 641, 662, 414/663, 664, 668, 672, 685, 785, 917, 667

[56] References Cited

U.S. PATENT DOCUMENTS

| | | | |
|---|---|---|---|
| 3,010,595 | 11/1961 | Stone | 214/701 |
| 3,106,305 | 10/1963 | Gehring | 214/730 |
| 3,482,722 | 12/1969 | Simovich | 414/641 |
| 3,966,070 | 6/1976 | Barth | 414/607 X |
| 4,032,184 | 6/1977 | Blair . | |
| 4,095,714 | 6/1978 | Schuster | 214/620 |

FOREIGN PATENT DOCUMENTS

| | | | |
|---|---|---|---|
| 149907 | 5/1955 | Sweden | 414/641 |
| 697316 | 1/1978 | U.S.S.R. | 414/917 |

OTHER PUBLICATIONS

Harricana Metal Inc., Brochure FP-158A-79, "Side--Tilt Grapple for Tree-Length Logs" (2 pages).

Harricana Metal Inc., Brochure FP-160A-79, "Grapple for Logs and Lumber" (2 pages).

*Primary Examiner*—Robert J. Spar

*Assistant Examiner*—Donald W. Underwood

[57] ABSTRACT

A load support assembly including a base plate pivotally mounted to the lift arm of a supporting vehicle. A linking arm pivotally mounted to the base plate at one end and having a lift fork pivotally mounted at the other end. A hydraulic cylinder pivotally mounted to the base plate at one end and has a lift fork pivotally mounted at the other end. A linking arm is pivotally mounted to the base plate at one end and has another lift fork pivotally mounted at the other end. A member is pivotally mounted to both lift forks to maintain the lift forks in parallel alignment. A second hydraulic cylinder is pivotally mounted to the base plate at one end and to the linking arm at the other end to impart rotational displacement to the linking arm.

3 Claims, 7 Drawing Figures

LOAD SUPPORT ASSEMBLY

BACKGROUND OF THE INVENTION

This invention relates to load support assemblies and more particularly, to load support assemblies which are attachable to off-road vehicles having elevating means, and still more particularly to attachable load support assemblies which can rotate and side shift a supported load.

Conventionally, a load support assembly is designed and attached to a vehicle as a permanent fixture. The load support assembly is generally designed to handle only a specific type of material, thereby limiting the uses of a carrying vehicle.

SUMMARY OF THE INVENTION

It is an object of the present invention to present an attachable load support assembly with the capability of side shifting and/or side tilting a supported load. It is a further objective of the present invention to present a load support assembly which can be adapted to handle a variety of materials.

In the preferred embodiment, a vehicle having lift arms is attachable to the load support assembly such that the lift arms can raise and lower the load support assembly in a vertical direction. The load support assembly is comprised of a base plate which can be pivotally and detachably mounted to the lift arms of a vehicle such that the base plate assumes a generally vertical orientation. On the front face of the base plate are a plurality of vertically suspended linking arms placed parallel to one another. A linking member is pivotally mounted to both linking arms to maintain the linking arms in a parallel orientation. A hydraulic cylinder is attached to one linking arm to impart side shift motion to the linking arms. A load support element, as for example lift forks, is attached to the lower end of the lift arms for supporting a load, therefore by activating the cylinder the load is shifted to the side. Additionally, one of the link arms can be replaced by a second hydraulic cylinder which upon activation will cause a supported load to tilt.

In the alternative, the base plate can be rotationally mounted parallel to a first plate which in turn is secured to the lift arms of the vehicle. The second hydraulic cylinder can be attached at one end to the base plate and at its other end to the first plate such that activation causes the base plate to rotate with respect to the first plate such that attached link arms and load support means will cause a carrying load to tilt.

DETAILED DESCRIPTION OF THE PREFERRED EMBODIMENT

Figure 1:
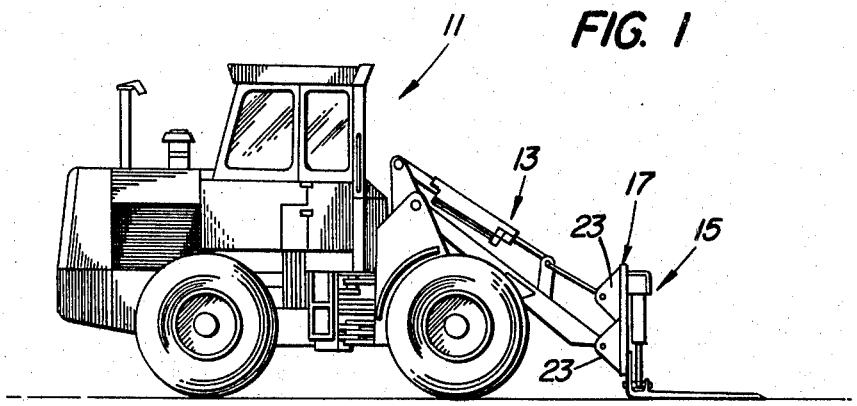
FIG. 1 is an elevated side view of a wheel loader having a load support assembly mounted thereto in compliance with the present invention.

Referring to FIG. 1 a wheel loader, generally indicated as 11, has an elevating assembly 13 mounted to a load support assembly generally indicated as 15.

Figure 2:
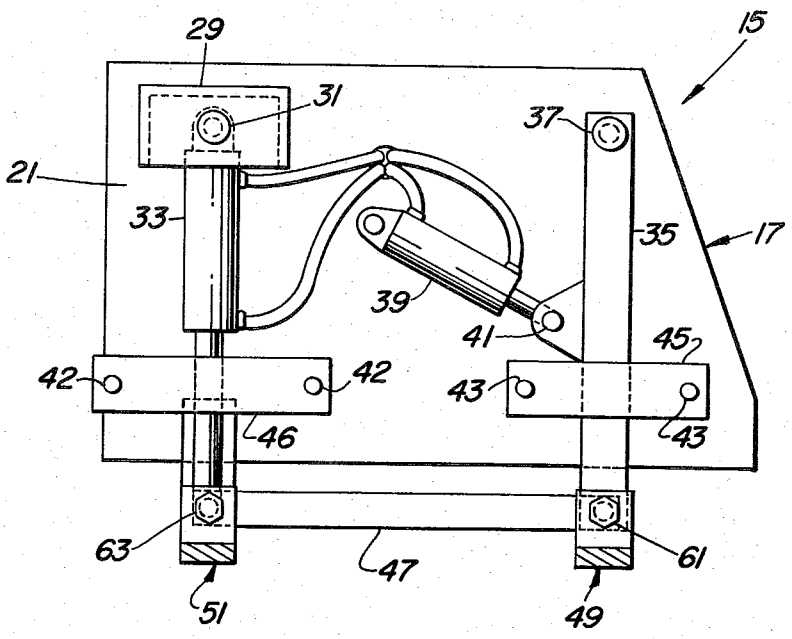
FIG. 2 is an elevated frontal view of load support assembly in compliance with the present invention.
Figure 3:
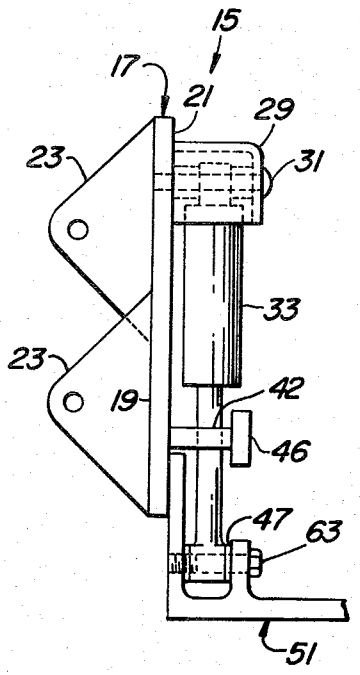
FIG. 3 is a side elevational view of the load support assembly.

Referring to FIGS. 2 and 3, the load support assembly 15 includes a base plate 17 having a back face 19 and front face 21. A plurality of mounting members 23 are formed in the back face 19 of base plate 17 for pivotally securing the load support assembly 15 to the elevation assembly 13 of the vehicle 11 by any conventional means. In the preferred embodiment a housing 29 is fixably mounted by any conventional means to the front left-hand side of face 21 of the base plate 15. The housing 29 is open at the bottom side to the housing 29 to contain one end of a hydraulic cylinder 33 between the housing 29 and a base plate 17 allowing the cylinder 33 to extend vertically downward therefrom. A pin 31 is passed through the housing 29, the enclosed end hydraulic cylinder 33 and fixably mounted in base plate 17 by any conventional means to allow the hydraulic cylinder 33 to be pivotally mounted to the base plate 17. A second pin 37 is passed through a linking arm 35 at one end and is fixably mounted by any conventional means to the base plate in the upper left-hand corner to pivotally maintain linking arm 35 to the base plate 17 allowing the linking arm 35 to have a generally downward vertical extension parallel with hydraulic cylinder 33.

A second hydraulic cylinder 39 is pivotally mounted by any conventional means at one end to the front face 21 of plate 17 and linking arm 35 at 41 at the other end thereof. The hydraulic cylinder 39 is placed at an angle with respect to linking arm 35 such that activation of the hydraulic cylinder 39 causes the linking arm 35 to pivot about pin 37. To retard the motion of linking arm 35 in a horizontal direction away from base plate 17, a plurality of stop posts 43 are fixably mounted by any conventional means to the base plate 17 having a portion of linking arm 35 therebetween. Mounted to the other end of the stop post 43 by any conventional means is a guide strut 45 to restrain any motion of linking arm 35 away from base plate 17. To restrain any motion of hydraulic cylinder 33 horizontally away from plate 17, one end of stop posts 42 is fixably mounted by any conventional means to the plate 17 having a portion of cylinder 33 therebetween. A second guide strut 46 is fixably mounted to the other end of stop post 42. A linking member 47 having fork-like ends has the other end of hydraulic cylinder 33 placed between the forks of one end of member 47 and has the other end of linking arm 35 placed between the forks of the remaining end of member 47. Removable pins 61 and 63 are passed through linking arm 35 and member 47, and cylinder 33 and member 47, respectively.

Figure 4A:
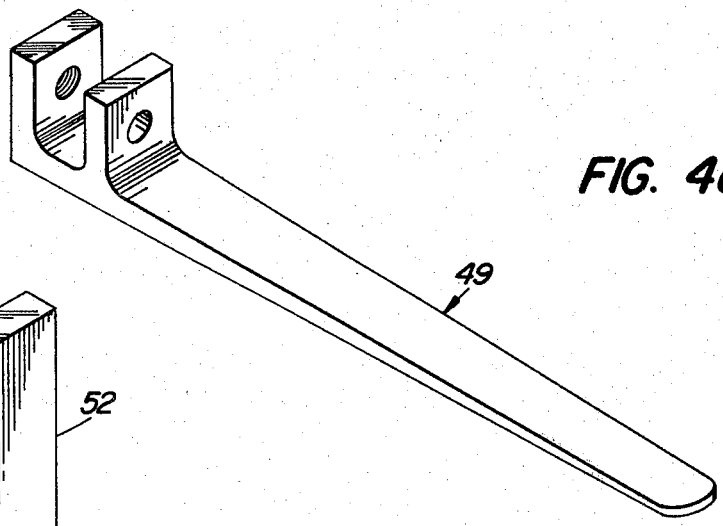
FIG. 4*a* is a prospective view of a first lift fork.
Figure 4B:
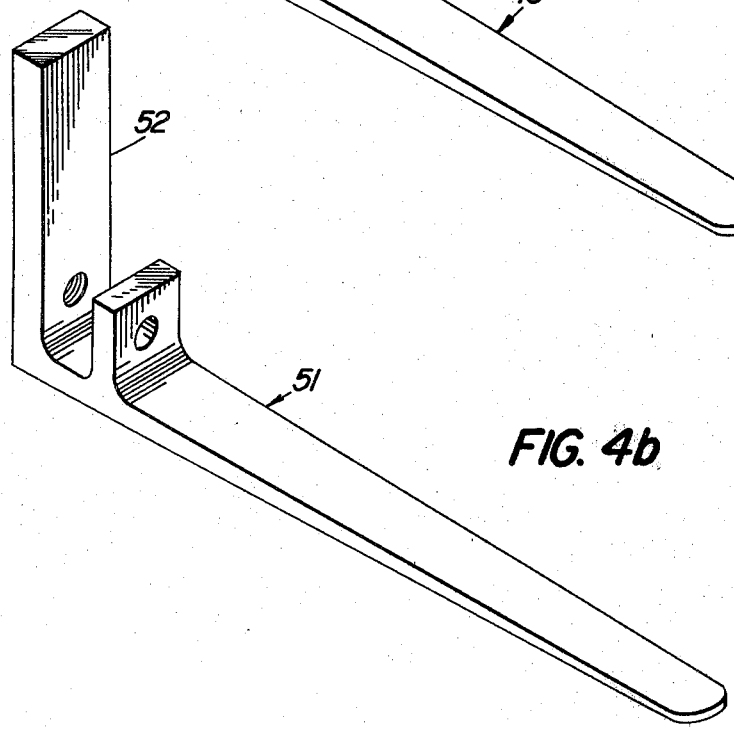
FIG. 4*b* is a prospective view of a second lift fork.

Referring more particularly to FIGS. 4*a* and 4*b* in conjunction with FIGS. 2 and 3, lift forks 49 and 51, of generally conventional design, are attached to linking arm 35 and hydraulic cylinder 33, respectively, and supported by respective pins 63 and 61. It is observed that lift fork 51 has a vertical extension 52 abutting face 21 of base plate 17 such that in conjunction with strut 46 vertical motion of the hydraulic cylinder 33 is restrained.

It is observed, should a load be carried by forks 49 and 51, that by actuating hydraulic cylinder 39 the load will be shifted sideways or longitudinally with respect to base plate 17. It is further observed by activation of hydraulic cylinder 33 the load carried by forks 49 and 51 will be tilted with respect to pin 61.

Figure 5:
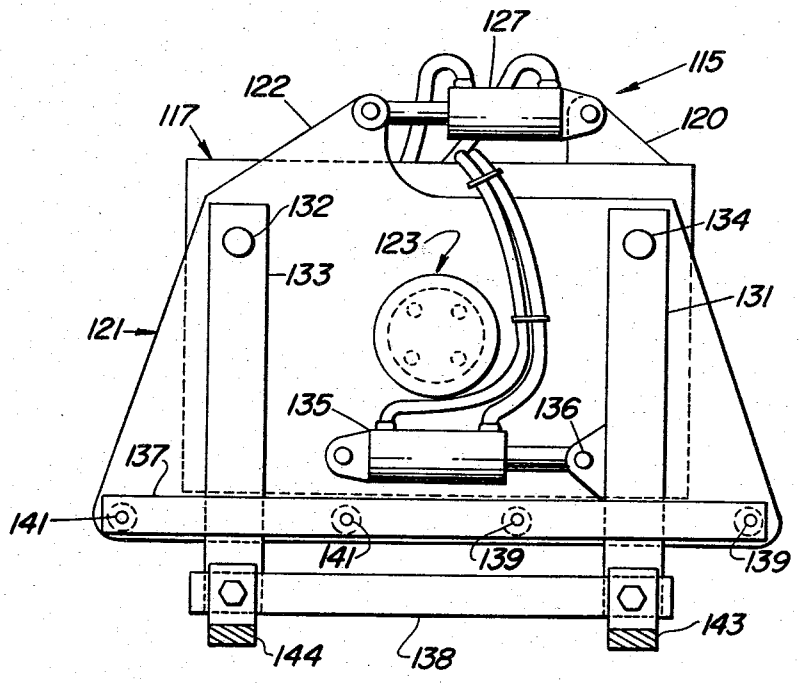
FIG. 5 is a front elevational view of an alternative embodiment of the load support assembly.
Figure 6:
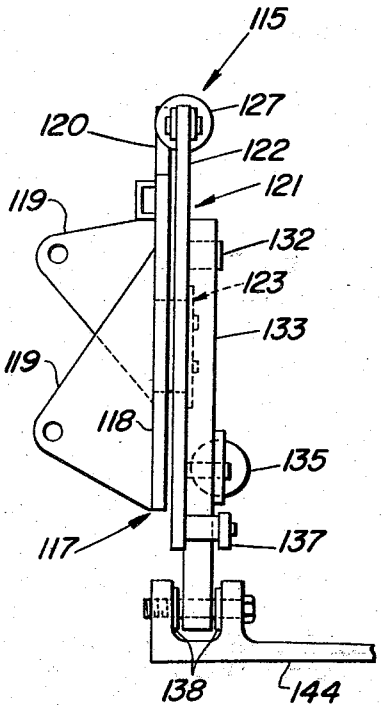
FIG. 6 is a side elevational view of the alternative embodiment of the load support assembly.

Referring to FIGS. 5 and 6, an alternative embodiment is shown wherein the load support assembly, generally indicated as 115, includes a first plate 117 having mounting post 119 formed in the back face 118 of plate 117 for mounting to a vehicle elevation assembly 13. A bearing assembly 123 of conventional design is mounted to the first plate 117 generally at its geometric center and supports a second or base plate 121 at its general geometric center in a conventional manner opposite plate 117 such that the second plate 121 can rotate with respect to first plate 117. The first plate 117 has an extension 120 at its upper right-hand portion whereupon a hydraulic cylinder 127 is pivotally mounted at one end by any conventional means. The second plate 121 has an extension 122 located in its upper left-hand portion whereupon the other end of cylinder 127 is pivotally mounted by any conventional means to maintain cylinder 127 in a generally horizontal position.

A first and second link arm 131 and 133 respectively are pivotally mounted to the second plate 121 by any conventional means at 132 and 134 respectively such that link arms 131 and 133 are held in parallel opposite alignment to each other and second plate 121. A second hydraulic cylinder 135 is pivotally mounted to second plate 121 by any conventional means at one end and pivotally mounted by any conventional means at the other end to lift arm 131 at 136 such that the hydraulic cylinder 135 is in a generally horizontal alignment. A linking member 138 of identical construction to linking member 47 is pivotally mounted at its ends to respective lift arms 131 and 133 to maintain the lift arms 131 and 133 in parallel alignment. Further, a plurality of stop pins 139 and 141 are fixably mounted by any conventional means at one end to the second plate 121 such that lift arm 131 is between pins 139 and lift arm 133 is between stop pins 141. A restraining bar 137 is fixably mounted to the other end to stop pins 139 and 141. Conventional lift forks 143 and 144 are respectively detachably mounted by any conventional means to lift arms 131 and 133. It is observed that activation of cylinder 127 will cause the plate 121 to rotate with respect to plate 117 thereby causing a load supported by lift forks 143 and 144 to tilt. In addition, it is observed that activation of hydraulic cylinder 135 to act on linking arm 133 will cause the carrying load on lift forks 143 and 144 to side shift with respect to the second plate 121.

It should be observed that the above description is of the preferred embodiments and should not in any way be interpreted as limiting the scope of the present invention which is defined by the following claims. It should further be observed that the preferred and alternative embodiment has been described with the use of lift forks 49, 51, 143 and 144, however it should be understood that the lift forks can be replaced by other load supporting means such as lift grapples.

I claim:

1. In combination with a vehicle having vertically displaceable lift arms, a first plate vertically oriented and secured to and movable with said lift arms such that said first plate maintains a vertical orientation upon displacement of said lift arms, a second plate vertically disposed parallel to and opposite said first plate and rotatably mounted to said first plate such that said second plate can rotate about its geometric center, means for rotating said second relative to said first plate, a load support assembly comprising: a first link arm vertically disposed and pivotally mounted to said second plate at the upper end, a second link arm parallel to and opposite to said first link arm pivotally mounted to said second plate at the upper end, a linking member pivotally mounted to said first and second linking arm to maintain said linking arms in parallel alignment; a hydraulic cylinder secured to said second plate at one end and one of said linking arms at the other end to impart side motion to said linking arm upon activation of said cylinder.

2. In combination with a vehicle having vertically displaceable lift arms, a load support assembly comprising: a base plate pivotally mounted to said lift arms such that said base plate maintains a generally vertical orientation upon displacement of said lift arms; a linking arm pivotally mounted to said base plate at one end and extending generally vertically; a first lift fork pivotally mounted at one end to said other end of said linking arm and having a general extension outwardly from and perpendicular to said base plate and said linking arm; a second lift fork; a member pivotally mounted to said first lift forks such that said lift forks maintain a generally opposite and parallel alignment; first means for selectively adjusting the relative vertical position of said second lift fork with respect to said first lift fork and for selectively adjusting the relative longitudinal position of said lift forks relative to said base plate.

3. A load support assemble as claimed in claim 2 wherein said first means comprises a first hydraulic cylinder pivotally mounted to said base plate at one end and pivotally mounted to said linking arm at the other end; and, a second hydraulic pivotally mounted to said base plate at one end and pivotally mounted to said second lift arm at the other end, having a generally vertical extention parallel to said linking arm.

* * * * *